US008899572B2

(12) United States Patent
Gotoda

(10) Patent No.: US 8,899,572 B2
(45) Date of Patent: Dec. 2, 2014

(54) PRINTING APPARATUS WITH SHEET ENTRY INHIBITING CONTROLLER

(71) Applicant: Avision Inc., Hsinchu (TW)

(72) Inventor: Katsuhiko Gotoda, Hsinchu (TW)

(73) Assignee: Avision Inc. (TW)

( * ) Notice: Subject to any disclaimer, the term of this patent is extended or adjusted under 35 U.S.C. 154(b) by 0 days.

(21) Appl. No.: 13/934,966

(22) Filed: Jul. 3, 2013

(65) Prior Publication Data

US 2014/0008859 A1 Jan. 9, 2014

(30) Foreign Application Priority Data

Jul. 4, 2012 (TW) ..... 101123969 A

(51) Int. Cl.

| | |
|---|---|
| ***B65H 5/22*** | (2006.01) |
| ***B41J 13/00*** | (2006.01) |
| ***B65H 5/06*** | (2006.01) |
| ***B41J 3/60*** | (2006.01) |
| ***B41J 11/00*** | (2006.01) |

(52) U.S. Cl.

CPC ..... *B41J 13/0009* (2013.01); *B65H 5/06* (2013.01); *B41J 3/60* (2013.01); *B41J 11/006* (2013.01); *B41J 11/0095* (2013.01)

USPC ..... 271/4.02; 271/258.01; 399/20; 399/401

(58) Field of Classification Search

USPC ..... 271/4.02, 258.01, 262, 186; 399/20, 399/373, 401

See application file for complete search history.

(56) References Cited

U.S. PATENT DOCUMENTS

| | | | | |
|---|---|---|---|---|
| 8,391,730 | B2 * | 3/2013 | Kitagawa | 399/20 |
| 2010/0119244 | A1 * | 5/2010 | Kitagawa | 399/21 |
| 2011/0079953 | A1 * | 4/2011 | Ishii et al. | 271/262 |

* cited by examiner

*Primary Examiner* — Gerald McClain

(57) ABSTRACT

A printing apparatus comprising an image forming system, a sheet-feeding system, a sheet-transporting system, a sheet-controlling device, a sheet-detection device, a first driving system, a second driving system and a controller is provided. The sheet-controlling device and the sheet-detection device are disposed between the sheet-feeding system and the sheet-transporting system. The sheet-controlling device controls an entry of a sheet into the sheet-transporting system. The first driving system drives the sheet-controlling device, and the second driving system drives a transporting mechanism of the sheet-transporting system. The controller upon receiving an error signal from the sheet-detection device signals the sheet-controlling device to inhibit the entry of the sheet into the sheet-transporting system and signals the transporting mechanism to continue its operation. A duplex printing method is also provided.

7 Claims, 11 Drawing Sheets

PRINTING APPARATUS WITH SHEET ENTRY INHIBITING CONTROLLER

CROSS REFERENCE TO RELATED APPLICATIONS

This application claims the benefit of the foreign application priority of Taiwan Application No. 101123969, which was filed on Jul. 4, 2012 and is incorporated herein by reference.

BACKGROUND OF THE INVENTION

1. Field of the Invention

The present invention relates generally to a printing apparatus and a duplex printing method, and especially relates to the printing apparatus which continues carrying out an ongoing image-forming process even in the event of a multi-feed, paper jam or misfeed, and the duplex printing method performed by such printing apparatus.

2. Description of the Prior Art

A conventional printer would terminate a print job right away in the event of a multi-feed, paper jam or misfeed, and generate an alert to the user requesting the user to remove the sheet remained in the machine, and finally automatically restart the print job after the clearance. The page in the middle of the printing process at the moment the error occurs would be considered an unfinished document and reprinted after the error has been cleared, resulting in a waste of time, toner and paper.

Therefore, the present invention provides a printing apparatus and a duplex printing method to solve the above problems.

SUMMARY OF THE INVENTION

Accordingly, an object of the present invention is to provide a printing apparatus which utilizes a sheet-controlling device and two independent driving systems to complete the print process which will not be interrupted by the occurrence of the multi-feed, paper jam or misfeed, and a duplex printing method performed by such printing apparatus.

In one embodiment, the present invention relates to a printing apparatus. The printing apparatus comprises an image forming system, a sheet-feeding system, a sheet-transporting system, a sheet-controlling device, a sheet-detection device, a first driving system, a second driving system and a controller. The sheet-transporting system, comprising a sheet-circulating path and a transporting mechanism, receives a recording medium from the sheet-feeding system and transports the recording medium through an image forming system. The transporting mechanism moves the recording medium along the sheet-circulating path. The image forming system, in the sheet-circulating path, forms an image on the recording medium. The sheet-controlling device and the sheet-detection device are disposed between the sheet-feeding system and the sheet-transporting system. The sheet-controlling device controls an entry of a sheet into the sheet-transporting system. The first driving system drives the sheet-controlling device, and the second driving system drives the transporting mechanism. The controller upon receiving an error signal from the sheet-detection device signals the sheet-controlling device to inhibit the entry of the sheet into the sheet-transporting system and signals the transporting mechanism to continue its operation.

Further, in another embodiment, the present invention relates to a duplex printing method performed by a printing apparatus. The duplex printing method comprises the following steps: feeding in a first sheet; transporting the first sheet along a sheet-circulating path; forming an image on a front side of the first sheet; feeding in a second sheet; detecting a sheet-feeding error; inhibiting an entry of the second sheet into the sheet-circulating path; forming an image on a back side of the first sheet; and ejecting the first sheet.

The printing apparatus of the present invention when detecting any paper feeding error would instruct the sheet-controlling device to stop the advancing of a paper sheet in front of the sheet-transporting system and continue the ongoing image-forming process for the paper sheet(s) already inside the sheet-transporting system until the print data designated for the sheet(s) are completely printed thereon. The duplex printing method of the present invention improves the efficiency of a printing process, where the printing apparatus would prioritize the ongoing image-forming process over the clearance of paper feeding error and finish the printing of the data onto the sheets inside the sheet-transporting system. After the error is cleared, the printing apparatus would start from printing of the data for the sheet being stopped by the sheet-controlling device.

These and other objects, features and advantages of the present invention will become apparent upon consideration of the following detailed description of the preferred embodiment that is illustrated in the various figures and drawings.

BRIEF DESCRIPTION OF THE DRAWINGS

FIGS. 2A, 2B, 2C, 2D, 2E, 2F and 2G are explanatory views of the sheet conveyance operation when a sheet-feeding error occurs when a second sheet is being fed in.

FIGS. 3A, 3B, 3C, 3D, 3E, 3F, 3G, 3H and 3I are explanatory views of the sheet conveyance operation when a sheet-feeding error occurs when a third sheet is being fed in.

DETAILED DESCRIPTION

Figure 1A:
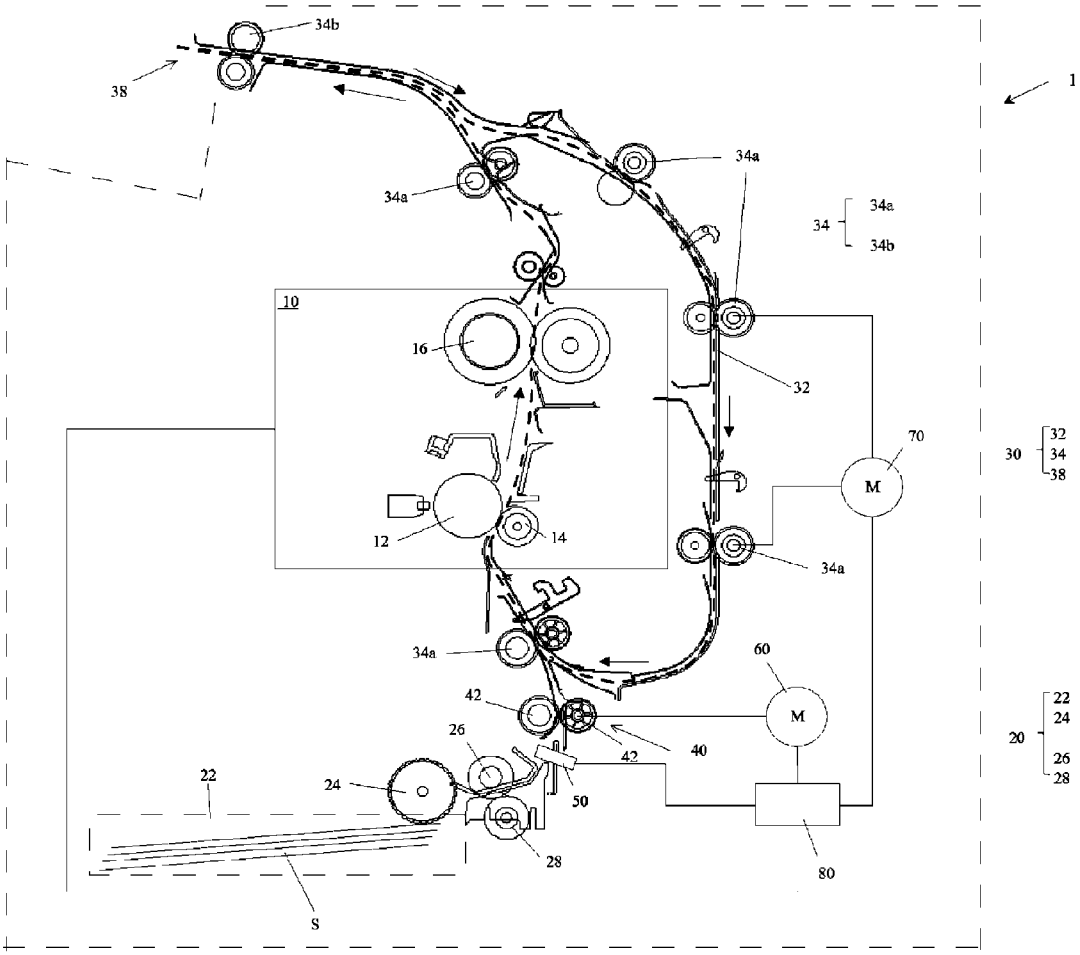
FIGS. 1A and 1B are elevation views of printing apparatuses according to a preferred embodiments of the present invention.
Figure 1B:
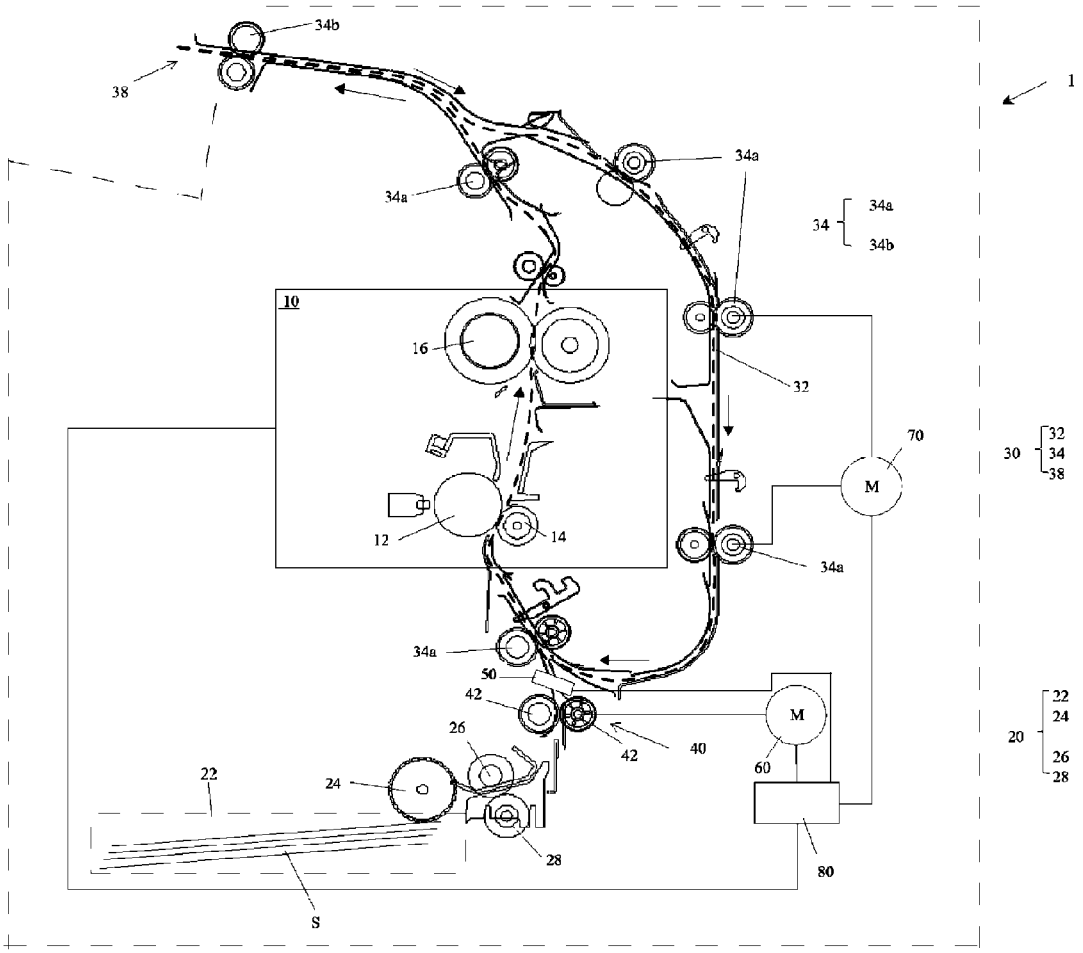

FIGS. 1A and 1B are elevation views of printing apparatuses 1 according to preferred embodiments of the present invention. As shown in FIG. 1A, the printing apparatus 1 comprises an image forming system 10, a sheet-feeding system 20, a sheet-transporting system 30, a sheet-controlling device 40, a sheet-detection device 50, a first driving system 60, a second driving system 70 and a controller 80. The image forming system 10 forms an image on a recording medium, for example a sheet of paper. The printing apparatus 1 in this embodiment is an electro-photographic printer, where the image forming system 10 comprises at least a photosensitive drum 12, an image transfer roller 14 and a fusing device 16.

The sheet-feeding system 20 comprises a paper cassette 22 or a manual paper feeding entrance, a feeding roller 24, a separation roller 26 and a retard roller 28. The feeding roller 24 picks up a sheet S from the paper cassette 22, or the manual paper feeding entrance, and transports to the separation roller 26 and the retard roller 28. The separation roller 26 and the retard roller 28 separate the sheet S from other sheets to make sure that only one sheet at one time will pass through the image forming system 10. The sheet-transporting system 30 comprises a sheet-circulating path 32, a transporting mechanism 34 and a sheet outlet 38. The sheet-transporting system 30 receives the sheet S from the sheet-feeding system 20 and transports the sheet S through the image forming system 10. The transporting mechanism 34 moves the sheet S along the sheet-circulating path 32. When the sheet S is transported through the image forming system 10, the image forming system 10 forms an image on the sheet S. To print images on both sides of the sheet S, the transporting mechanism 34 moves the sheet S through the image forming system 10 twice along the sheet-circulating path 32. The transporting mechanism 34 comprises at least a transfer roller pair 34*a* and a switching roller pair 34*b*. The sheet-controlling device 40 and the sheet-detection device 50 are disposed between the sheet-feeding system 20 and the sheet-transporting system 30. As shown in FIG. 1A, the sheet-detection device 50 is disposed at a position upstream of the sheet-controlling device 40 in a sheet conveyance direction. The sheet S passes the sheet-detection device 50 before reaching the sheet-controlling device 40. Alternatively, the sheet-detection device 50 may be disposed at a position downstream of the sheet-controlling device, as shown in FIG. 1B. The sheet-controlling device 40 controls an entry of the sheet S into the sheet-transporting system 30. The sheet-detection device 50 detects the feeding states of the sheet S. The sheet-detection device can be a thickness sensor which utilizes ultra-sonic technology. Once a sheet-feeding error is detected the sheet-detection device sends an error signal to the controller 80.

The first driving system 60 drives the sheet-controlling device 40. The second driving system 70 drives the transporting mechanism 34. The first driving system 60 and the second driving system 70 are independent of each other and may consist of power generating components such as motors and solenoid vales. In this embodiment, the sheet-controlling device 40 includes an entrance roller pair 42 driven by a motor and selectively rotated. However, the sheet-controlling device 40 may be a stopper board selectively blocking the passage to the sheet-transporting system 30. The stopper board can be driven to extend and retract by a motor or a solenoid valve.

The controller 80 controls the operations of the printing apparatus 1. Upon receiving the error signal from the sheet-detection device 50, the controller 80 signals the sheet-controlling device 40 to inhibit the entry of the sheet S into the sheet-transporting system 30. The controller 80 further signals the transporting mechanism 34 to continue the operation of the transporting mechanism 34, particularly when a recording medium is already in the sheet-circulating path 32 and in the middle of the image forming process. In this embodiment, the controller 80 upon receiving the error signal from the sheet-detection device 50 discontinues rotation of the entrance roller pair 42 to stop the sheet S from being conveyed into the sheet-circulating path 32. The sheet-controlling device 40 may otherwise be composed of another type of transport component, such as a belt conveyor or a vacuum force creating unit which draws the sheet to move or maintain it at the same position.

Figure 2B:
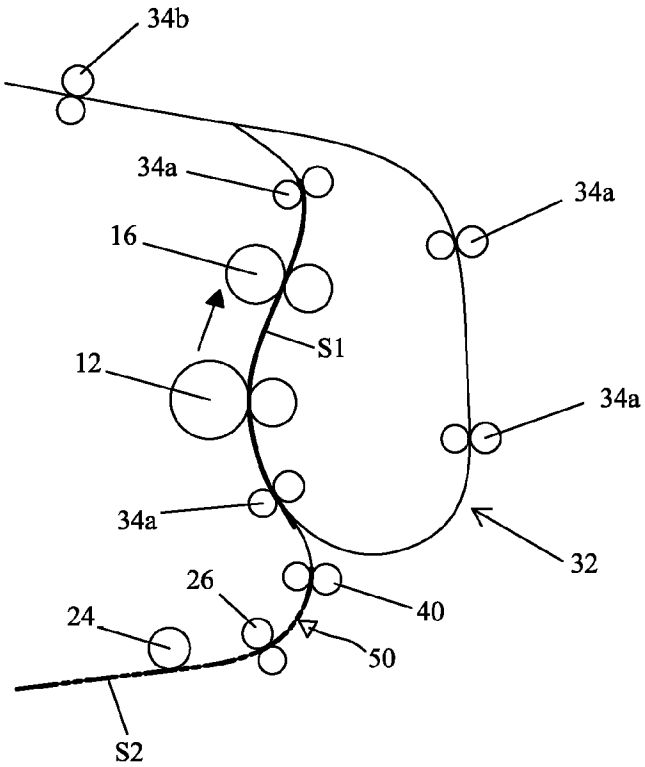
Figure 2A:
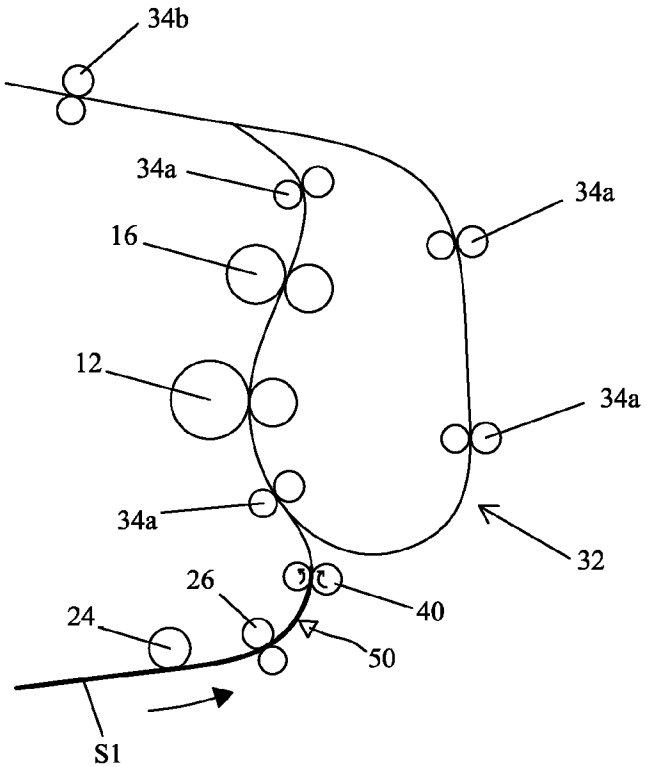
Figure 2D:
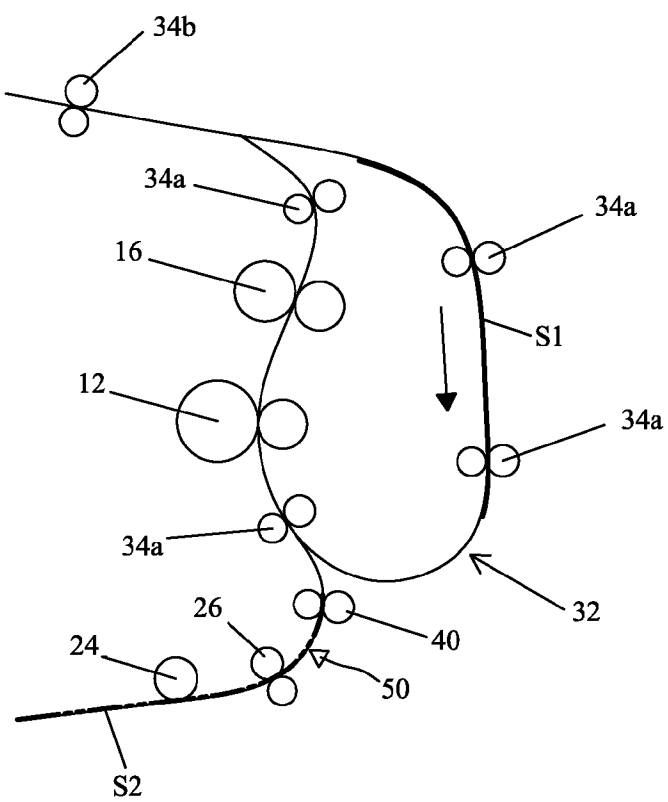
Figure 2C:
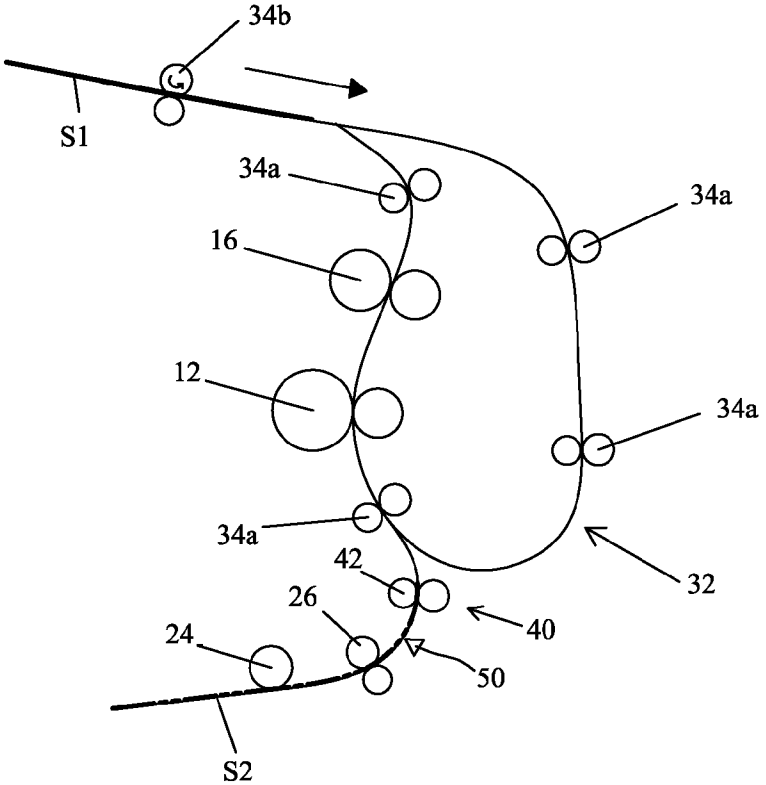
Figure 2F:
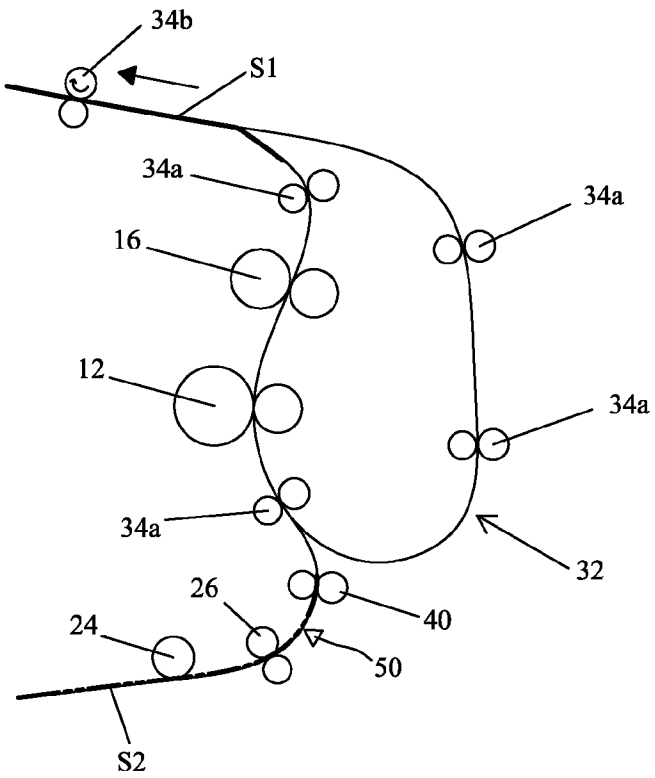
Figure 2E:
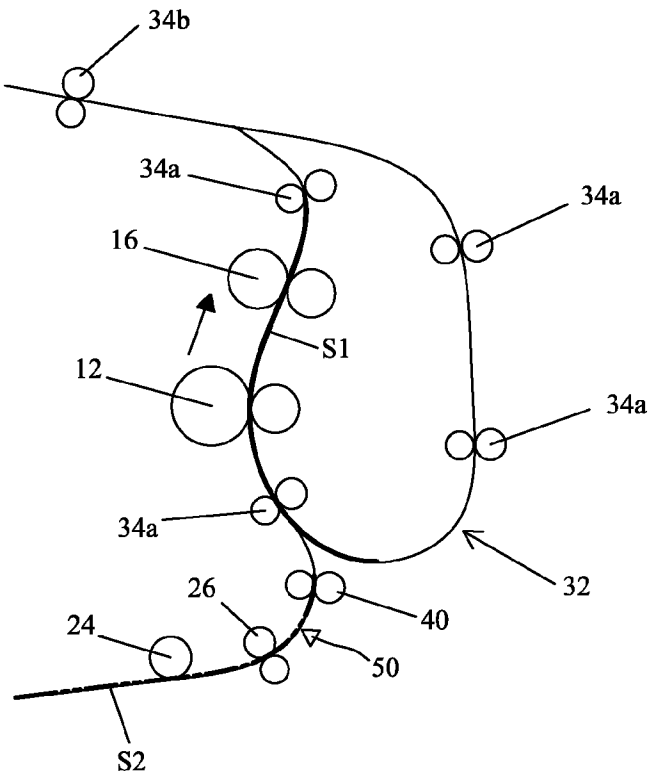
Figure 2G:
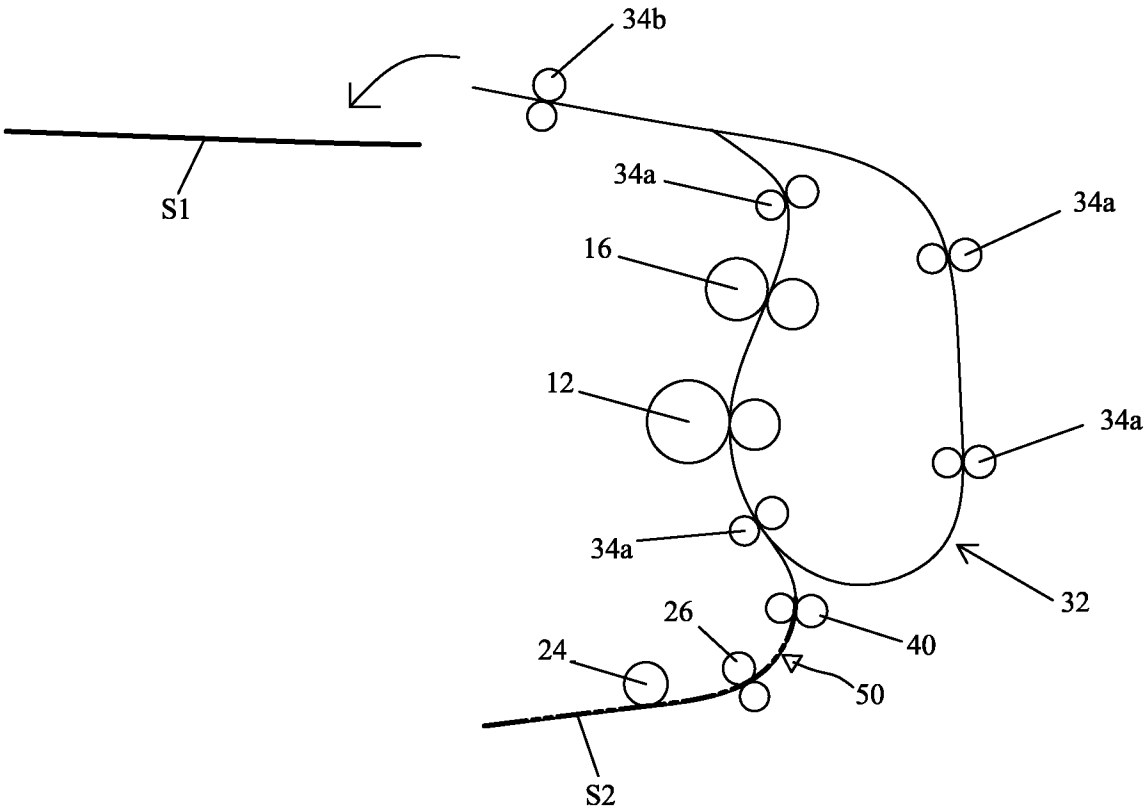

FIGS. 2A, 2B, 2C, 2D, 2E, 2F and 2G are explanatory views of the sheet conveyance operation when a sheet-feeding error occurs when a second sheet S2 is being fed in. Referring to FIG. 2A, the sheet-feeding system 20 first feeds in a first sheet S1. The first sheet S1 is then transported past the sheet-detection device 50; if the sheet-detection device 50 detects no sheet-feeding error, the sheet-controlling device 40 transports the first sheet S1 to the sheet-circulating path 32 and the image forming system 10 forms an image on the front side of the first sheet S1, as shown in FIG. 2B. At this time, the sheet-feeding system 20 feeds in the second sheet S2. If the sheet-detection device 50 detects a sheet-feeding error when the second sheet S2 passes, the sheet-controlling device 40 inhibits the entry of the second sheet S2 into the sheet-circulating path 32. As shown in FIG. 2C, when the second sheet S2 reaches the entrance roller pair 42, the rotation of the entrance roller pair 42 is discontinued, and the second sheet S2 is not transported by the entrance roller pair 42 to the sheet-circulating path 32. Referring to FIGS. 2C to 2G, the second sheet S2 is stopped at the entrance roller pair 42 in front of the sheet-circulating path 32 during the period of time when the first sheet S1 is returned by the switching roller pair 34*b* to the sheet-circulating path 32 and transported through the image forming system 10 which forms an image on a back side of the first sheet S1, and finally is ejected from the printing apparatus 1. According to the duplex printing method of the present invention, despite the sheet-detection device 50 detects the sheet-feeding error caused by the second sheet S2, the transporting mechanism 34 and the image forming system 10 would not cease but finish the printing process for the first sheet S1. In this way, the user can remove the second sheet S2 from the printing apparatus 1 without interrupting the printing process for the first sheet S1.

Figure 3B:
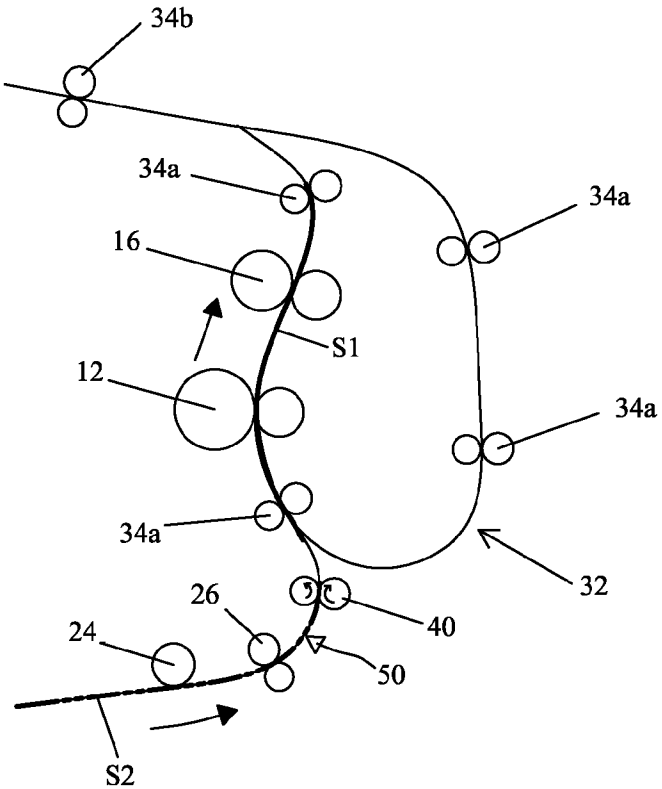
Figure 3A:
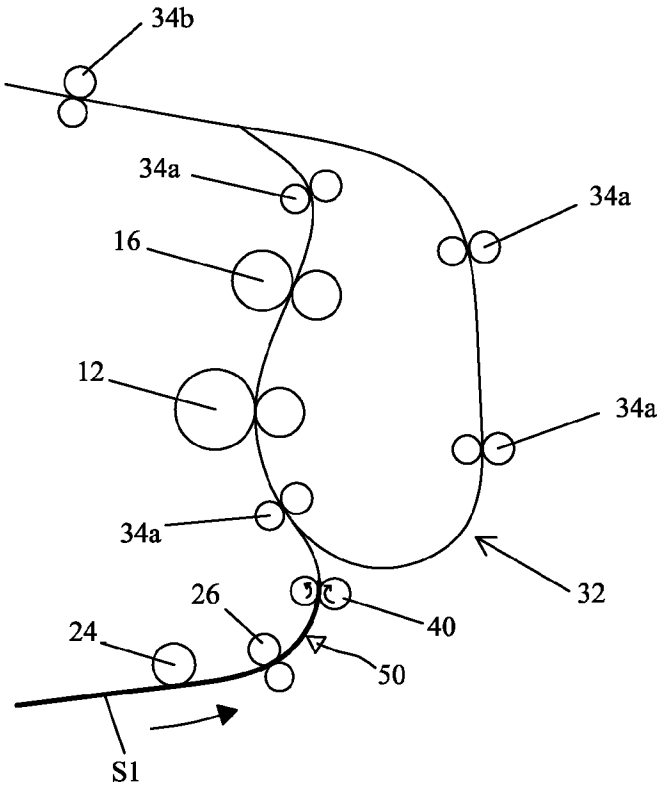
Figure 3D:
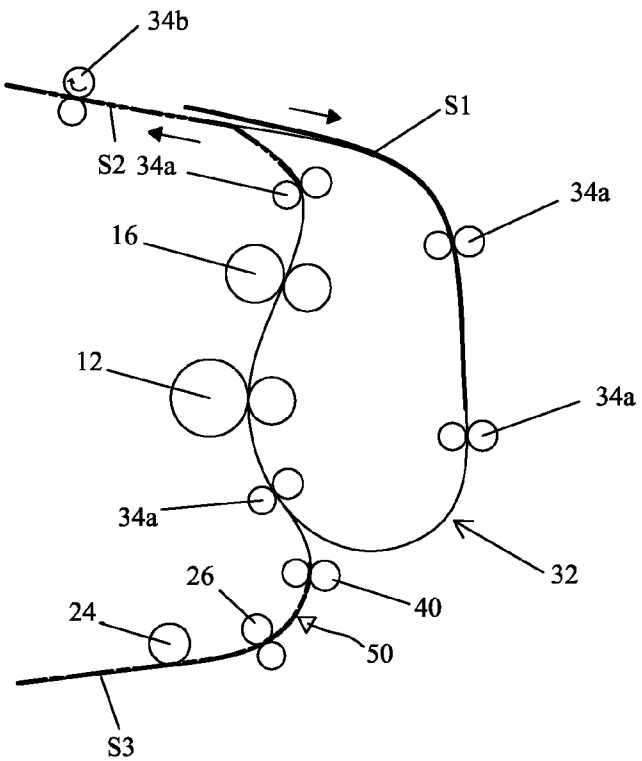
Figure 3C:
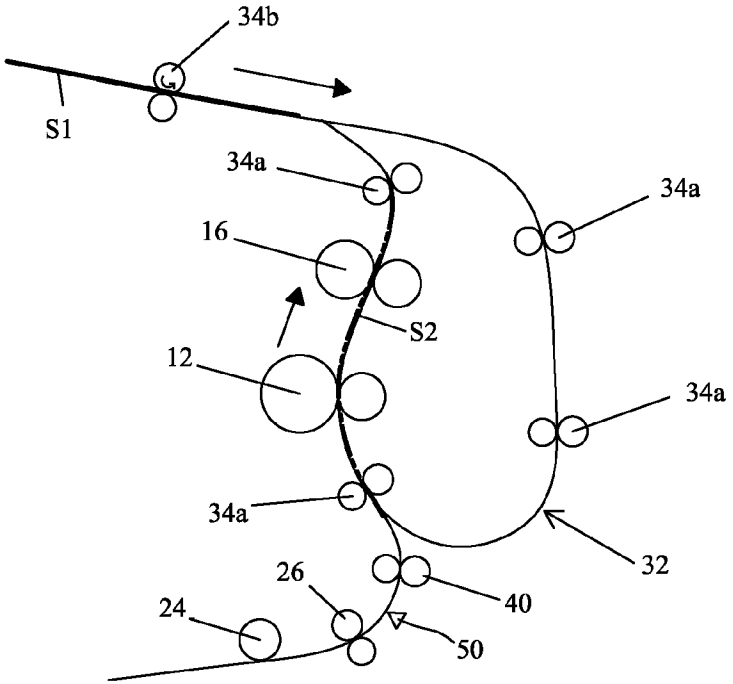
Figure 3F:
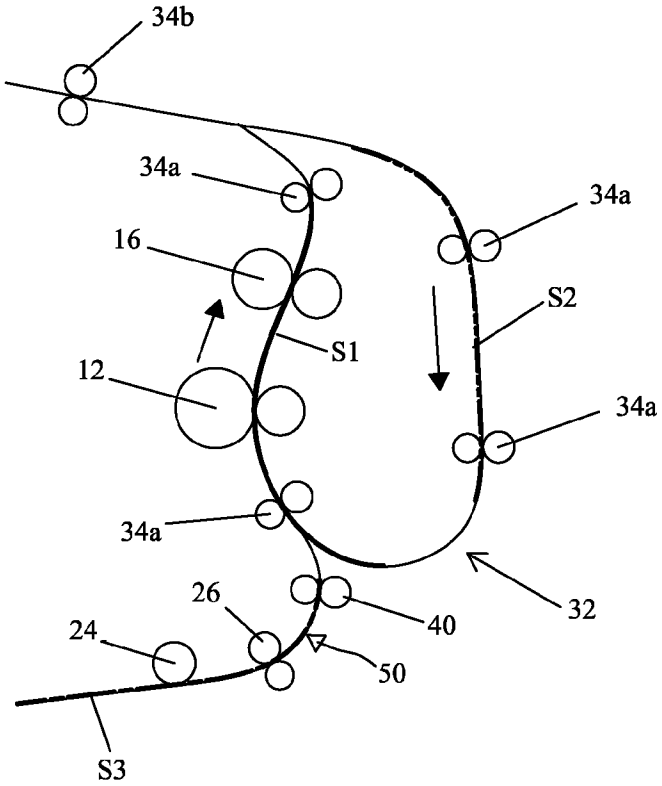
Figure 3E:
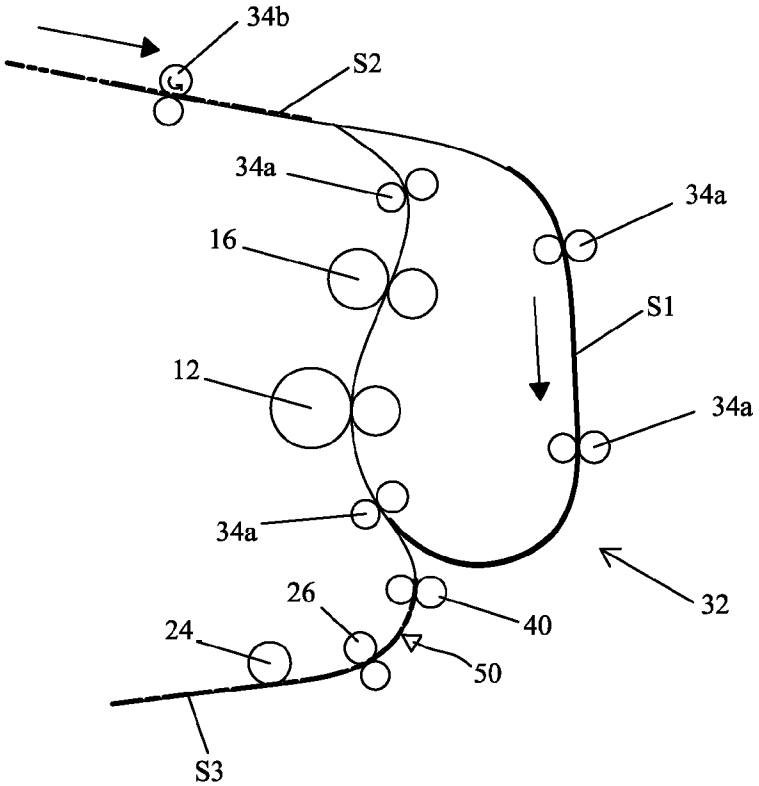
Figure 3G:
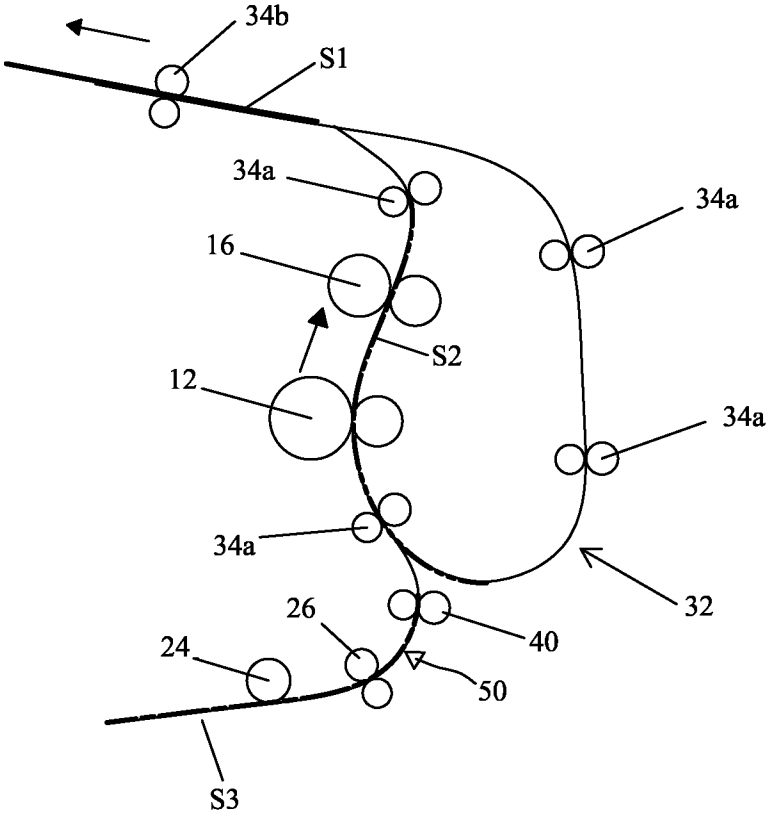
Figure 3I:
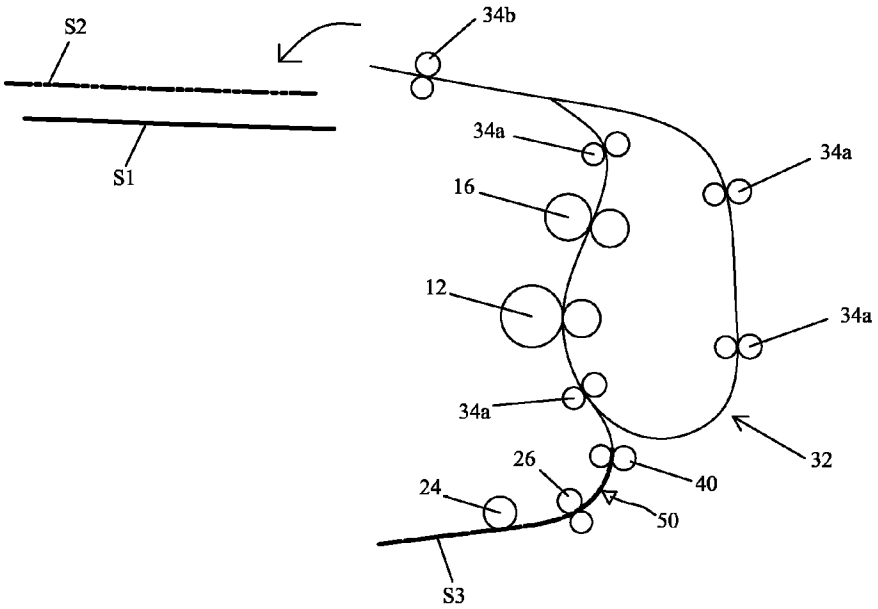
Figure 3H:
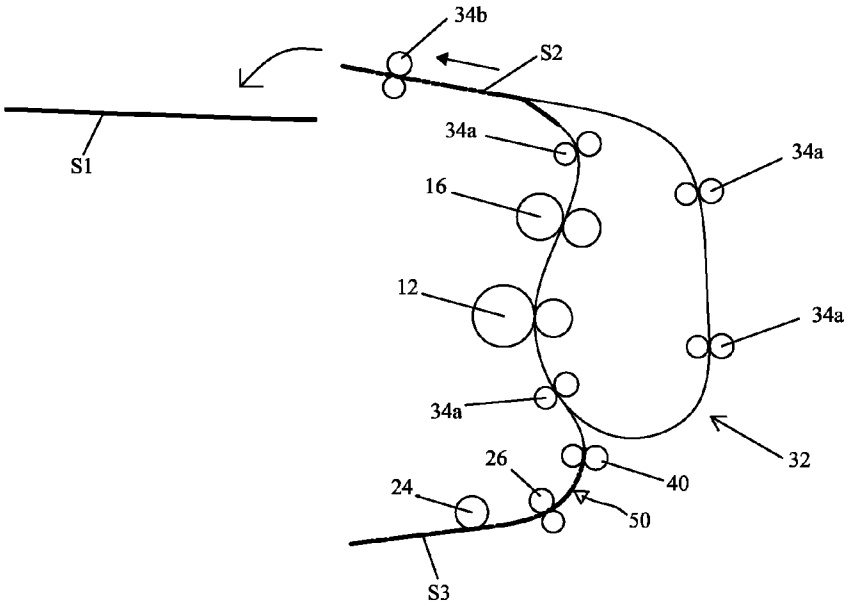

FIGS. 3A, 3B, 3C, 3D, 3E, 3F, 3G, 3H and 3I are explanatory views of the sheet conveyance operation when a sheet-feeding error occurs when a third sheet S3 is being fed in. Referring to FIGS. 3A to 3C, the sheet-feeding system 20 first feeds in a first sheet S1. If the sheet-detection device 50 detects no sheet-feeding error, the sheet-controlling device 40 transports the first sheet S1 to the sheet-circulating path 32. Next, the image forming system 10 forms an image on a front side of the first sheet S1, and the sheet-feeding system 20 feeds in a second sheet S2. If the sheet-detection device 50 detects no sheet-feeding error when the second sheet S2 passes, the sheet-controlling device 40 transports the second sheet S2 into the sheet-circulating path 32. The image forming system 10 forms an image on a front side of the second sheet S2. Referring to FIG. 3D, the first sheet S1 is returned by the switching roller pair 34*b* to the sheet-circulating path 32 to have the image forming system 10 forming an image on a back side of the first sheet S1. The second sheet S2 is transported to the switching roller pair 24*b* after the image is formed on its front side. At this time, the sheet-feeding system 20 feeds in the third sheet S3 which is transported past the sheet-detection device 50 and then to the sheet-controlling device 40. If the sheet-detection device 50 detects a sheet-feeding error when the third sheet S3 passes, the sheet-controlling device 40 inhibits the entry of the third sheet S3 into the sheet-circulating path 32. As shown in FIG. 3E, when the third sheet S3 reaches the entrance roller pair 42, the rotation of the entrance roller pair 42 is discontinued, and the third sheet S3 is not transported by the entrance roller pair 42 to the sheet-circulating path 32. Referring to FIGS. 3F to 3I, the third sheet S3 is stopped at the entrance roller pair 42 in front of the sheet-circulating path 32 during the period of time when the first sheet S1 and the second sheet S2 each are being transported for a second time through the image forming system 10 and have the images formed on their back side, and then are ejected from the printing apparatus 1. According to the duplex printing method of the present invention, when two sheets of paper are circulated in the sheet-circulating path 32, the third sheet S3 which causes the sheet-feeding error would be retained at a position in front of the sheet-circulating path 32; and in the mean time, the printing apparatus 1 carries out the printing operation for the first two sheets until printing is completed.

While the present invention has been described with respect to a limited number of embodiments, it is to be understood that the present invention is not limited to the disclosed exemplary embodiments. It is intended that the appended claims cover all modifications, equivalent structures and variations as fall within the true spirit and scope of this present invention. The specification and drawings are, accordingly, to be regarded in an illustrative rather than a restrictive sense.

What is claimed is:

1. A printing apparatus, comprising:

a sheet-feeding system;

a sheet-transporting system, comprising a sheet-circulating path and a transporting mechanism, for receiving a recording medium from the sheet-feeding system and transporting the recording medium through an image forming system, wherein the transporting mechanism moves the recording medium along the sheet-circulating path;

said image forming system, in the sheet-circulating path, forming an image on the recording medium;

a sheet-controlling device, disposed between the sheet-feeding system and the sheet-transporting system, the sheet-controlling device controlling an entry of a sheet into the sheet-transporting system;

a sheet-detection device, disposed between the sheet-feeding system and the sheet-transporting system;

a first driving system for driving the sheet-controlling device;

a second driving system for driving the transporting mechanism; and a controller, wherein the controller upon receiving an error signal, which is sent from the sheet-detection device when the sheet-detection device detects of a sheet-feeding error, signals the sheet-controlling device to inhibit the entry of the sheet into the sheet-transporting system and signals the transporting mechanism to continue an operation of the transporting mechanism;

wherein the controller, which upon receiving the error signal from the sheet-detection device signals the transporting mechanism to continue the operation of the transporting mechanism, so that the transporting mechanism and the image forming system finish a printing process for the recording medium until print data are completely printed on the recording medium.

2. A printing apparatus of claim 1, wherein the sheet-detection device is disposed at a position upstream of the sheet-controlling device in a sheet conveyance direction.

3. A printing apparatus of claim 1, wherein the sheet-detection device is disposed at a position downstream of the sheet-controlling device in a sheet conveyance direction.

4. A printing apparatus of claim 1, wherein upon receiving the error signal from the sheet-detection device the controller discontinues operation of the sheet-controlling device.

5. A printing apparatus of claim 4, wherein the sheet-controlling device comprises an entrance roller pair.

6. A printing apparatus of claim 1, wherein the transporting mechanism moves the recording medium through the image forming system twice along the sheet-circulating path.

7. A printing apparatus of claim 1, wherein the sheet-detection device comprises a thickness sensing unit.

* * * * *